United States Patent [19]

Kubert et al.

[11] Patent Number: 4,493,257

[45] Date of Patent: Jan. 15, 1985

[54] INKER FOR A PRINTING PRESS

[75] Inventors: Vincent T. Kubert; John C. Frampton; George Y. Ono, all of Arlington, Tex.

[73] Assignee: Harris Graphics Corporation, Melbourne, Fla.

[21] Appl. No.: 545,177

[22] Filed: Oct. 25, 1983

[51] Int. Cl.[3] ..... B41F 31/14; B41L 27/16

[52] U.S. Cl. ..... 101/349

[58] Field of Search ..... 101/348, 349, 351, 352, 101/DIG. 14, 148, 354–358, 353

[56] References Cited

U.S. PATENT DOCUMENTS

| | | | |
|---|---|---|---|
| 223,981 | 2/1880 | Bissinger | 101/DIG. 14 |
| 400,221 | 3/1889 | King | 101/DIG. 14 |
| 1,222,744 | 4/1917 | Doyle | 101/DIG. 14 |
| 2,040,331 | 5/1936 | Peyrebrune | 101/348 |
| 2,242,214 | 5/1941 | Huck | 101/DIG. 14 |
| 3,902,417 | 9/1975 | Fischer | 101/425 |
| 3,983,812 | 10/1976 | Schramm | 101/349 |

FOREIGN PATENT DOCUMENTS

| | | | |
|---|---|---|---|
| 140227 | 2/1980 | Fed. Rep. of Germany | 101/DIG. 14 |
| 93150 | 6/1982 | Japan | 101/349 |

*Primary Examiner*—J. Reed Fisher

*Attorney, Agent, or Firm*—Yount & Tarolli

[57] ABSTRACT

An inker for applying ink to a lithographic printing plate having ink-receptive and ink-rejecting areas. Certain of the ink-receptive areas of the plate are to print substantially the same color as the other of the ink-receptive areas and are disposed in axially adjacent circumferential sections of the printing plate. The circumferential sections of the printing plate have different percentages of ink-receptive areas. The inker comprises a form roll having a cylindrical outer surface, means for applying an ink film to the entire cylindrical outer surface of the form roll and means for supporting the form roll so that the cylindrical outer surface has an ink-transferring engagement with the printing plate. A smooth coating of ink is applied to the axially adjacent circumferential ink-receptive sections of the printing plate due to axial movement of the form roll while the form roll is in the ink-transferring engagement with the printing plate.

10 Claims, 4 Drawing Figures

INKER FOR A PRINTING PRESS

BACKGROUND AND SUMMARY OF THE INVENTION

The present invention relates to an inker for use in a printing press and, in particular, relates to an inker for applying ink to a lithographic printing plate which has ink-receptive and ink-rejecting areas.

An inker for a lithographic printing press includes an ink fountain having a rotatable fountain roller and a doctor blade. Ink keys adjust the space between the fountain roller and the doctor blade to control the thickness of the ink film transmitted to the fountain roller. The ink is transferred from the fountain roller by a plurality of ink distribution rollers. The ink distribution rollers transmit the ink to a plurality of form rollers which apply the ink film to the printing plate. The ink distribution rollers include vibrating rollers which oscillate axially as they rotate.

A major ink starvation problem has been encountered in the printing of certain images by lithographic printing presses having an inker as noted above. The problem centers around the printing of images in the same color and shade where the image includes at least two portions, one portion which extends angularly relative to the other portion, such as where the image is, in effect, a picture frame such as printed on the cover of magazines, or an L or U or the like.

Typically, such an image is printed by directing the material to be printed through the press so that, for example, one side of the picture frame or one leg of the L is parallel to the direction of movement of the material through the press, and the other leg of the L or another side of the picture frame extends perpendicular to the direction of movement of the material through the press. Thus, the printing plate has abutting ink-receptive areas which extend circumferentially around the plate cylinder different distances and extend axially different distances. Hence, adjacent circumferential sections of the printing plate have different percentages of ink-receptive areas.

The ink starvation problem that has been encountered in the printing of such images is that one portion of the image will not be the same shade as the other portion of the image, and a very sharp distinct change in color occurs in the image which change in color is very visible to the human eye. Typically, the portion of the image which is printed by the ink-receptive plate area of the greatest circumferential extent around the plate cylinder (the circumferential section of the plate having the greatest percentage of ink-receptive area) is lighter in shade than the other portion of the image, and the change in shade is distinct, occurs along a line and is very visible to the human eye.

Prior attempts to increase the amount of ink which is applied to the ink-receptive area of the plate which prints the portion of the image which has the greatest circumferential extent around the cylinder have failed to solve the starvation problem. These efforts have involved adjustment of the inker including adjustment of the ink keys and changing the length and frequency of oscillation of vibrator rollers of the inker.

In accordance with the present invention, the aforementioned starvation problem is solved by providing the inker with an axially movable form roll. The axially movable form roll moves axially while it is transmitting ink to the plate on the plate cylinder. In this way, a circumferential section of the form roller which had been in contact with a nonink-receptive area of the plate moves to an ink-receptive area. This movement mates an area of nondepleted ink thickness on the form roll to an area of higher ink demand on the plate. This results in eliminating the very sharp distinct color change which is visible to the human eye. Unlike the conventional vibrator which moves only small thicknesses of ink laterally on the ink covered rolls, this invention moves large thicknesses of ink by moving the entire form roll.

In accordance with the preferred embodiment of the present invention, the inker includes three form rolls which are spaced circumferentially around the plate cylinder. The form roll, which is the last of the form rolls to be encountered by an area of the plate as it rotates, is the one that is axially movable. The axially movable form roll is mounted for rotation on a nonrotating central shaft. The form roll is also mounted for axial movement along the nonrotating shaft. The form roll is moved axially by its pressure engagement with a vibrating roll of the ink distribution system. Specifically, the axial movement of the vibrating roll causes axial movement of the form roll.

The form roll, however, is limited in its axial movement to an increment of the total axial movement of the vibrating roll. Specifically, the form roll will move axially small distances compared to that of the vibrating roll. As the vibrating roll moves axially from one extreme position, it will move the form roll axially a small increment. The form roll will then encounter a stop which limits axial further movement of the form roll with the vibrating roll. After the vibrating roll completes its total stroke, it starts to move in a reverse axial direction. The form roll will then move axially with the form roll an increment in the reverse direction. Thus, for a total cycle of movement of the vibrating roll, the form roll will move axially a predetermined distance, stop while the vibrating roll continues to move, then will move for the same predetermined distance in the reverse direction and stop while the vibrating roll continues to move to its initial or start position. This movement continues as long as printing occurs.

As a result of this incremental movement of the form roll, the amount of relative movement between the form roll and the printing plate is minimized. Thus, detrimental effects on the printing plate due to the relative movement of the form roll and printing plate are minimized. For example, if the form roll moved with the vibrating roll through its entire stroke, the ink-receptive and ink-rejecting areas, respectively, of the printing plate would be quickly worn. Thus, the life of the plate would be minimal. The axial movement of the form roll in accordance with the present invention is sufficient to eliminate the starvation problem but not sufficient enough to create significant wear of the printing plate.

Further, the inker of the present invention preferably includes a means for selectively preventing the axial movement of the form roll, if such movement is not required to eliminate the above discussed starvation problem for the image being printed.

BRIEF DESCRIPTION OF THE DRAWINGS

Further features and objects of the present invention will be apparent to those skilled in the art to which the present invention relates from the following description of a preferred embodiment of the invention made with reference to the accompanying drawings in which.

DESCRIPTION OF PREFERRED EMBODIMENT

As noted above, the present invention relates to an inker for a printing press and particularly to an inker for a lithographic printing press. In the printing of certain images, such as a picture frame which forms the cover of a magazine, an ink starvation problem has been encountered. The present invention is directed to the solution of that problem.

Figure 1:
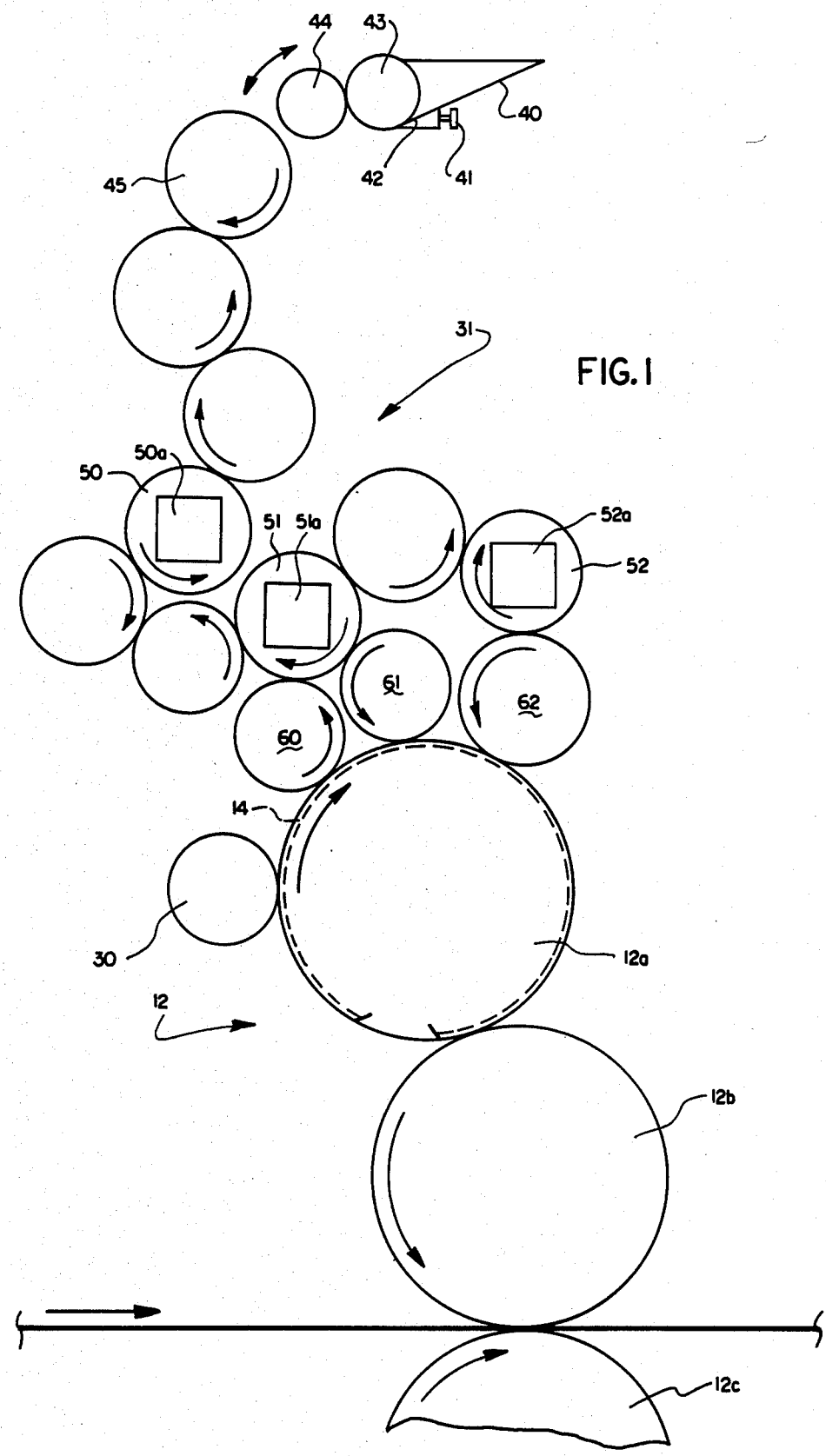
FIG. 1 is a schematic view illustrating an inker embodying the present invention.
Figure 4:
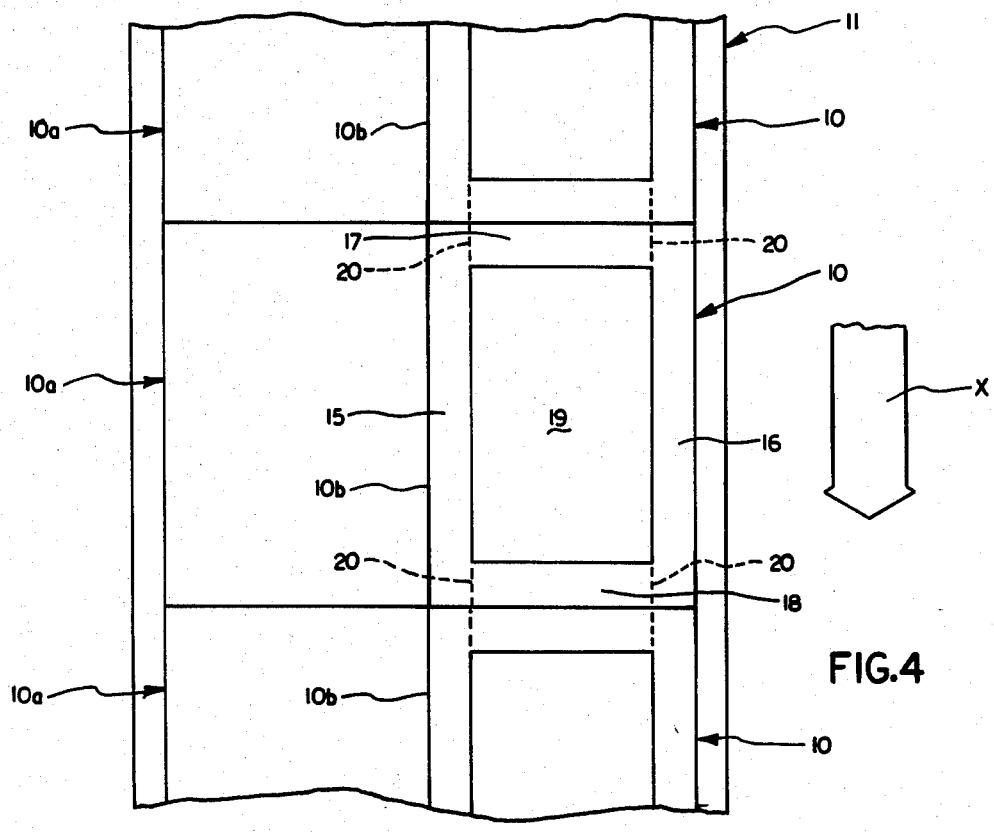
FIG. 4 is a view of a part of a web showing an image which is printed by the printing press embodying the inker of FIG. 1.

FIG. 4 illustrates a portion of a web of material 11 on which images which the form the cover for a magazine are being reproduced. The front cover of the magazine is designated 10 and the back cover is designated 10*a*. The front and back covers are separated at a fold line 10*b*. The images are printed on the web material 11 by a lithographic perfecting printing press 12 (FIG. 1). The printing press 12 includes a plate cylinder 12*a* and a blanket cylinder 12*b*. A lithographic printing plate 14 is secured to the plate cylinder by conventional means. The web material is advanced between the blanket cylinder 12*b* and a lower blanket cylinder 12*c* of the perfecting press as is known.

Each front cover image 10 includes image portions, 15, 16, 17, 18, see FIG. 4. Specifically, the image 10 includes two side image portions 15, 16 which extend in the direction of the web movement through the press indicated by arrow X in FIG. 4. Also, two portions 17, 18 interconnect portions 15, 16 and extend perpendicular to portions 15, 16. The portions 15, 16, 17 and 18 form, in effect, a picture frame surrounding the area 19. The area 19 is not printed in press 12 and the corresponding area of the printing plate 14 is ink rejecting. This area may be printed in another printing press unit. On the form rolls the form roll area corresponding to plate area 19 will have an excess of ink, while that corresponding to plate areas 15, 16, 17 and 18 will have a deficiency of ink.

In the printing of the images 10 such as those shown in FIG. 4, the starvation problem occurs in the areas which are indicated by the dotted lines 20. The lines 20 are located in the areas where the portions 15, 16 of the image which extend parallel to the direction of movement of the web material through the press abut the image portions 17, 18 which extend perpendicular to the direction of web movement through the press. At the lines 20 a sharp change in the shade of the color of the printing occurs. The image portions 17, 18 are printed with a deeper, more dense color shade than the image portions 15, 16. The difference in the shade which occurs at line 20 is dramatic and sharp. In fact, a substantial change in the color shade occurrs which is quite visible to the human eye. This, of course, is unacceptable where the total picture frame is to be printed in the same color and shade.

From the above, it should be clear to one skilled in the art that the printing plate 14 includes ink-receptive areas and ink-rejecting areas. For example, the areas of the plate 14 which correspond to print areas 15, 16, 17 and 18 are ink-receptive and the area of the plate 14 which corresponds to area 19 is ink-rejecting.

A dampener including a dampener form roll 30 applies dampening solution to the plate 14 as the plate 14 rotates. The ink rejecting area corresponding to area 19, for example, of the plate 14 is receptive to dampening solution and becomes covered therewith. The ink-receptive areas of the plate 14 correspond to the areas 15, 16, 17 and 18, and these areas receive ink from the printing press inker 31 as the plate 14 rotates. The ink is applied to the blanket cylinder 12*b* by the plate 14, and the blanket cylinder 12*b* then prints the images on the web material 11. From the above, it should be clear to one skilled in the art that the plate 14 has adjacent circumferential sections which are ink-receptive and that these sections extend circumferentially and axially different distances around the plate cylinder 12*a*.

The inker 31 of the printing press 12 is constructed so that the sharp change in shade between areas such as between areas 15 and 17 of the image are eliminated. In fact, a smooth coating of ink is applied to the various ink-receptive areas of the printing plate so that there is no sharp difference in the shade of the color which is printed in different portions of the image.

Specifically, the inker which embodies the present invention includes an ink fountain 40 having a fountain roll 43. A doctor blade 42 cooperates with the fountain roll 43 to control the amount of ink on the fountain roll 43 upon rotation of the fountain roll 43. A plurality of ink keys 41 are spaced along the doctor blade and are adjustable to adjust the space between respective portions of the doctor blade 42 and the fountain roll 43.

A conventional ductor roll 44 moves between the fountain roll 43 and an ink distribution roll 45 in the ink distribution roll system of the inker 31. The ductor roll 44 is controlled in its movement to control the amount of ink which is transferred from the fountain roll 43 to the ink distribution roll 45 as is conventional and known. The ink is transferred from the ink distribution roll 45 to the plate 14 on the plate cylinder 12*a* by the ink distribution system. Included in the ink distribution system are three vibrator rolls which are designated 50, 51 and 52. These vibrator rolls are moved axially as they rotate. Many different mechanisms may be used to move the vibrator rolls 50, 51 and 52 axially. Such mechanisms are known and shown schematically at 50*a*, 51*a*, 52*a*, respectively, for the rolls 50, 51, and 52. These mechanisms will not be described herein because such does not form a part of the present invention.

The ink is transmitted from the vibrator roll 51 to a pair of form rolls 60 and 61. The ink is transmitted from the vibrator roll 52 to an ink form roll 62. The ink form rolls 60, 61 and 62 are rubber covered rolls and apply ink to the printing plate 14 on the plate cylinder 12*a* after dampening solution is applied thereto. The form rolls 60 and 61 are fixed against axial movement.

The form roll 62, however, is mounted for axial movement along with the axial movement of the vibrator roll 52. The axial movement of the form roll 62 occurs due to its pressure engagement with the vibrating roll 52 and while the form roll 62 is in ink-transmitting relationship with the plate 14 on the plate cylinder 12*a*. The axial movement of the form roll 62 promotes the formation of a smooth film of ink on the ink-receptive areas of the plate 14, such as the areas corresponding to areas 15, 16, 17 and 18 of the image. This results in eliminating the very sharp color change which occurs between areas, such as between areas 15 and 17, of the printed image. The axial movement of form roll 62 replaces the ink deficient area corresponding to plate areas 15 and 16 with the ink surplus areas corresponding to area 19 on the plate. Thus, the line 20 is blurred so that it is no longer visible to the eye.

Figure 2:
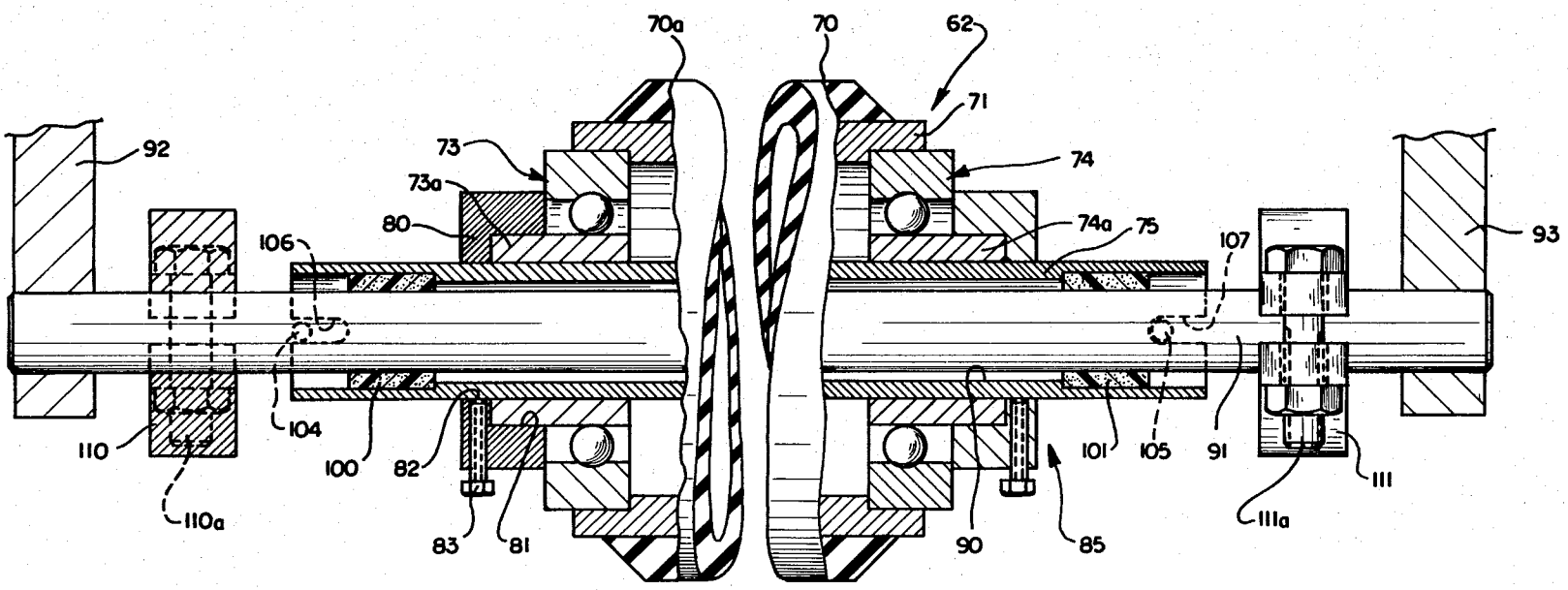
FIG. 2 is a cross-sectional view of one of the inker form rolls utilized in the inker of FIG. 1.

As best shown in FIG. 2, the axially movable form roll 62 comprises a rubber covering 70 on a metal shell 71. The metal shell 71 is supported at its opposite ends by a pair of bearings 73, 74. The bearings 73, 74 have internal races 73*a*, 74*a*, respectively, which are supported by a tubular member 75. The races 73*a*, 74*a* have axially projecting portions which extend axially along the tube 75 beyond the outer race of their respective bearings 73, 74.

A suitable clamp 80 clamps the projecting portion of inner race 73*a* of the bearing 73 against the tube 75. Specifically, the clamp 80 includes a surface 81 defining a central opening through the clamp 80 which is eccentric to the central opening 82 through the clamp member 80. The tubular member 75 extends through the central opening 82 in the clamp member 80 and when the clamp member 80 is rotated relative to the tubular member 75, the surface 81 of the clamp member bears against the outer diameter of the projecting portion 73*a* of the bearing 73. As a result, the clamp member 80 clamps the projecting portion 73*a* of the inner race of the bearing 73 tightly to the tubular member 75. A set screw 83 is used to secure the clamp 80 to the tube 75. A similar mechanism generally designated 85 is used to secure the bearing 74 to the tube 75.

The tube 75 is a hollow member having a central passage 90 extending therethrough. A shaft 91 extends through the central passage 90 and is fixedly supported at its opposite ends in frame members 92 and 93. Frame members 92 and 93 are supported for pivotal movement about the axis of rotation of the vibrating roll 52. An air cylinder and linkage (not shown) is used to rotate the frame members 92, 93 about the axis of roll 52 to move (throw-off) the form roll 62 away from the plate cylinder 12*a*.

The tube 75 has a pair of bearings 100, 101 located at its opposite ends. The bearings 100, 101 are located in the passage 90 through the tube 75. The bearings 100 and 101 support the tube 75 for axial movement on the shaft 91.

The shaft 91 has a pair of pins 104, 105 located at its opposite ends. The pins 104, 105 extend radially through the shaft 91 and project to opposite sides thereof. The ends of pin 104 are received in diametrically opposite slots 106 formed in one axial end of the tube 75. The ends of pin 105 are received in diametrically opposite slots 107 formed in the other axial end of the tube 75. Specifically, there are two slots 106, 107 located at diametrically opposite portions at each respective end of the tube 75 and each slot receives a respective end of a respective pin located at its end of the tube 75.

From the above, it should be clear that the shaft 91 is not a rotatable shaft, it is fixed in the frame members 92 and 93 and therefore cannot rotate about its own axis. The form roll 62, however, does rotate about the axis of the shaft 91 on bearings 73, 74.

Further, it should be clear that the form roll 62, the bearings 73, 74, clamp mechanisms 80, 85, and the tube 75 are axially slidable on the shaft 91. The amount of axial sliding movement of these parts is determined by the length of the slots 106 and 107 in the tube 75. Since the pins 104 and 105 are attached to the shaft 91 and extend into the slots 106 and 107 in the tube 75, these pins function to limit or stop the axial movement of the form roll 62.

More specifically, assuming the form roll 62 is in the position shown in FIG. 2, pin 105 prevents movement of the form roll 62 toward the right. As the form roll 62 moves toward the left, the opposite ends of pin 104 will engage the bottom of the grooves 106. This will stop the movement of the form roll 62 toward the left relative to the shaft 91. Thereafter form roll 62 as it moves to the right is stopped by engagement of the opposite ends of pin 105 with the bottom of the grooves 107, when the form roll 62 returns to the position in which the parts are illustrated in FIG. 2.

The inker 31 of the present invention also includes a pair of clamp structures 110 and 111 which are supported on the shaft 91 and are located at opposite ends of the tube 75. The clamp structures 110, 111 may be adjusted along the shaft 91 and can be relatively moved into a position in engagement with the opposite ends of the tube 75. When the clamp structures 110, 111 are in this position, they may be secured fixedly to the shaft 91 by fasteners 110*a*, 111*a*, respectively, which fasten opposite parts of the clamp structures together. In this position, the clamp structures 110 and 111 block movement of the form roll 62 axially relative to the shaft 91 and the printing plate 14.

As noted above, the form roll 62 of the present invention when it moves axially along the shaft 91, moves axially as a result of its engagement with the vibrator roll 52. The form roll 62 is moved axially while it is in ink transferring relationship with the printing plate 14. The printing plate 14 has ink-receptive and ink-rejecting areas and a significant amount of movement of the form roll 62 on the plate 14 would detrimentally affect the plate 14 and cause wear of the plate 14. This would detrimentally affect the printing after a predetermined length of time. In order to minimize the amount of wear of the plate 14 and yet still eliminate the above discussed starvation problem, the amount of movement of the form roll 62 axially relative to the plate 14 is restricted to only an increment of the movement of the vibrator roll 52.

Figure 3:
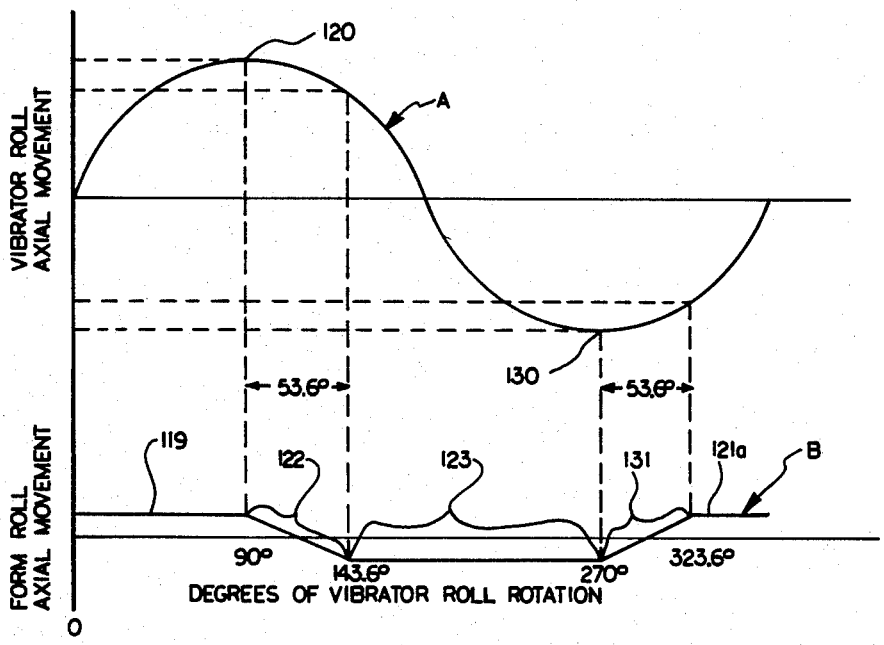
FIG. 3 is a graphical representation of the movement of a pair of rolls which are embodied in the inker of FIG. 1.

The movements of the vibrator roll 52 and the form roll 62 are graphically illustrated in FIG. 3. The horizontal scale shown in FIG. 3 indicates degrees of rotation of the vibrator roll. The vertical scale indicates the lateral motion of the both the vibrator roll and the form roll as indicated. The vibrator roll lateral motion is indicated by the line A and the form roll lateral motion is indicated by the line B.

At the zero degree position of the vibrator roll 52, the vibrator roll 52 it is in a central position relative to the form roll 62 and the vibrator roll 52 is moving toward one of its extreme positions, assuming toward the right in FIG. 2, and the form roll is blocked from axial movement. As shown by the line A, at approximately 90 degrees of rotation of the vibrator roll 52, the vibrator roll 52 reaches its extreme position, for example, its extreme position to the right, in FIG. 2. The vibrator roll extreme position is designated 120 on the line A. During this movement, the form roll 62 merely sits in its extreme position shown in FIG. 2 and does not move axially. This is indicated by the portion 119 of the line B.

The vibrator roll 52 then begins moving toward the left from its extreme right position designated by the point 120. As it moves from its extreme right position during approximately 53.6 degrees of rotation of the vibrator roll 52, the form roll 62 will move from its extreme position shown in FIG. 2 axially to its left extreme position. This movement of the form roll 62 is indicated by the portion 122 of line B, of FIG. 3. The form roll 62 moves until the ends of pin 104 engage the bottom of the grooves 106 in the tube 75.

Thereafter, the form roll 62 cannot follow axial movement of the vibrator roll 52. The form roll 62 then stays in its left extreme position without continuing axial movement and this is designated by the region 123 of the curve B. The vibrator roll 52 continues its movement to the opposite extreme left position in FIG. 2. This position is designated 130 on the line A.

The vibrator roll 52 then reverses its direction of axial movement and the form roll 62 will again move in the opposite direction along with movement of the vibrator roll 52. This occurs from a point of approximately 270 degrees of rotation of the vibrator roll 52 to approximately 323.6 degrees of rotation of the vibrator roll. This movement of the form roll 62 is indicated by the region 131 of the curve B. The form roll then stops its axial movement by engagement of the ends of pin 105 with the bottom of the grooves 107 in the tube 75. The vibrator roll 52 continues to move to the right, but the form roll 62 cannot move, it is stopped by the pin 105. The form roll 62 thus is in a fixed position designated by the area 121*a* of the curve B. The vibrator roll 52 then continues its movement toward the left and the process is repeated.

Thus, the form roll 62 moves axially only for a predetermined increment of the movement of the vibrator roll 52. However, even though the form roll 62 moves only a small amount axially as compared to the axial movement of the vibrator roll 52, the starvation problem noted above is eliminated and the image 10 does not have a sharp color change, but rather receives a smooth film of ink. Thus, the image portions 15, 16, 17 and 18 appear to the human eye to be printed in the same color and shade. Moreover, since the amount of movement of the form roll 62 relative to the plate 14 is incremental, there is no detrimental effect on the printing plate.

In a preferred embodiment of the invention, the vibrator roll makes a complete cycle of movement, i.e., across the press and back to its initial position during 360 degrees of rotation. This corresponds to approximately the length of three impression lengths printed on the web. The motion of the form roll is only 5/32 of an inch in each direction for a total of 5/16 of an inch. The motion in each direction occurs in about one-half of an impression length. This small motion is adequate to eliminate the starvation pattern that occurs on the form roll and in the printed image but is not large enough nor often enough to cause significant plate wear. It is preferred that the form roll move axially during only about $\frac{1}{3}$ of the movement of the vibration roll.

The axial length of the form roll 62 is equal to the axial length of the plate cylinder 12*a*. The plate 14 on the plate cylinder 12*a* does not extend axially across the plate cylinder. The axial dimension of the printing plate is less than that of the form roller 62, and sufficiently less so that the form roller 62 extends across the printing plate in all positions of the form roller 62. The vibrator roller 52 is axially longer than the form roller 62, and sufficiently longer so that the vibrator roller 52 is in ink-transferring relation with the form roll 62 continuously along the entire axial extent of the form roll 62.

What is claimed is:

1. An inker for applying ink to a lithographic printing plate having ink-respective and ink-rejecting areas, certain of said ink-receptive areas which are to print substantially the same color as the other of said ink-receptive areas being disposed in axially adjacent circumferential sections of the printing plate, which circumferential sections have different percentages of ink-receptive areas, said apparatus comprising a form roll having a cylindrical outer surface, means for applying an ink film to the entire cylindrical outer surface of said form roll, means for supporting said form roll so that said cylindrical outer surface has an ink-transferring engagement with the printing plate, and means for promoting the application of a smooth coating of ink to axially adjacent circumferential ink-receptive sections of the printing plate, said means for promoting the application of a smooth coating of ink including means for moving said form roll axially while the form roll is in said ink-transferring engagement with the printing plate to present ink from different axial portions of the form roll to the same circumferential section of the plate, a form roll shaft fixed against rotation about its own axis, a member extending along said shaft and axially slidable relative to said shaft, a pair of bearings interposed between said member and said form roll and supporting said form roll for rotation about said shaft, and means for clamping at least a part of said bearings to said member for axial movement along said shaft upon axial movement of said form roll.

2. An inker as defined in claim 1 further including a series of rolls forming an ink distribution chain, one of said rolls of said ink distribution chain comprising a vibrator roll which rotates to transfer ink to said ink form roll and moves axially, and said means for moving said form roll axially is said vibrator roll.

3. An inker as defined in claim 2 further including means for limiting axial movement of said form roll to substantially less than the axial movement of said vibrator roll.

4. An inker as defined in claim 3 wherein said form roll moves axially during about one-third of the total axial movement of said vibrator roll.

5. An inker as defined in claim 1 further including a series of rolls forming an ink distribution chain, one of said rolls comprising a vibrator roll which rotates and transfers ink to said ink form roll and moves axially in opposite directions through a predetermined distance, and means for limiting the distance of axial movement of said form roll to less than the axial movement of said vibrator roll.

6. An inker as defined in claim 1 wherein said member comprises a tube which encircles said shaft and said shaft has spaced pins located therein which are located in slots in said tube and said pins engage said tube to restrict movement of said tube in opposite axial directions.

7. An inker as defined in claim 1 further including means movable into a position to block axial movement of said member and thus of said form roll.

8. An inker for applying ink to a lithographic printing plate having ink-receptive and ink-rejecting areas, certain of said ink-receptive areas which are to print substantially the same color as the other of said ink-receptive areas being disposed in axially adjacent circumferential sections of the printing plate, which circumferential sections have different percentages of ink-receptive areas, said apparatus comprising a form roll having a cylindrical outer surface, means for applying an ink film to the entire cylindrical outer surface of said form roll, means for supporting said form roll so that said cylindrical outer surface has an ink-transferring engagement with the printing plate, and means for promoting the application of a smooth coating of ink to axially adjacent circumferential ink-receptive sections of the printing plate, said means for promoting the application of a smooth coating of ink including means for moving said form roll axially while the form roll is in said ink-transferring engagement with the printing plate to present ink from different axial portions of the form roll to the same circumferential section of the plate, said means for moving said form roll axially comprising a vibrator roll for transferring ink to said form roll and which moves axially as it transfrs ink to said form roll, a form roll shaft fixed against rotation about its own axis, a member extending along said shaft and supporting said form roll for rotation about said shaft, said member being axially slidable relative to said shaft along with said form roll, and adjustable means movable along said shaft to selected positions to engage said member to thereby limit the axial movement of said member and said form roll along said shaft to a predetermined variable amount of the axial movement of said vibrator roll.

9. An inker as defined in claim 8 wherein said adjustable means comprises two clamps supported on said shaft and located on opposite sides of said member.

10. An inker as defined in claim 8 including bearing means interposed between said member and said shaft for supporting said member for sliding movement along said shaft.

* * * * *